US011291320B2

(12) United States Patent
Bailey

(10) Patent No.: US 11,291,320 B2
(45) Date of Patent: Apr. 5, 2022

(54) BUNTING BAG

(71) Applicant: TOMY International, Inc., Dyersville, IA (US)

(72) Inventor: Kellyn Bailey, Logan, UT (US)

(73) Assignee: TOMY International, Inc., Dyersville, IA (US)

( * ) Notice: Subject to any disclaimer, the term of this patent is extended or adjusted under 35 U.S.C. 154(b) by 286 days.

(21) Appl. No.: 16/054,172

(22) Filed: Aug. 3, 2018

(65) Prior Publication Data

US 2020/0037795 A1 Feb. 6, 2020

(51) Int. Cl.

| | |
|---|---|
| ***A47G 9/06*** | (2006.01) |
| ***A47G 9/08*** | (2006.01) |
| ***A41B 13/06*** | (2006.01) |
| ***A47D 15/00*** | (2006.01) |

(52) U.S. Cl.

CPC ..... *A47G 9/068* (2013.01); *A41B 13/06* (2013.01); *A47D 15/006* (2013.01); *A47G 9/083* (2013.01)

(58) Field of Classification Search

CPC ..... A47D 15/006; A47G 9/083; A47G 9/068; A41B 13/06; B60N 2/2881; A41D 11/00; B62B 9/108

See application file for complete search history.

(56) References Cited

U.S. PATENT DOCUMENTS

| | | | | |
|---|---|---|---|---|
| 6,012,189 A * | 1/2000 | Dudley | A47D 15/00 | 5/416 |
| 7,384,098 B1 * | 6/2008 | Allwin | A47G 9/068 | 297/219.12 |
| 8,256,839 B2 * | 9/2012 | Schropfer | B62B 9/142 | 297/219.12 |
| 8,650,663 B2 * | 2/2014 | Fair | A47G 9/068 | 2/69.5 |
| 2010/0170039 A1 * | 7/2010 | Davis | B60N 2/2812 | 5/494 |
| 2010/0237671 A1 * | 9/2010 | Danziger | B60N 2/2812 | 297/219.12 |
| 2012/0284897 A1 * | 11/2012 | Fair | A47G 9/068 | 2/69.5 |

FOREIGN PATENT DOCUMENTS

| | | | |
|---|---|---|---|
| FR | 2901980 A1 * | 12/2007 | A47G 9/068 |
| GB | 2455321 A * | 6/2009 | A47D 15/006 |

* cited by examiner

*Primary Examiner* — Ryan D Kwiecinski

(74) *Attorney, Agent, or Firm* — Saul Ewing Arnstein & Lehr LLP

(57) ABSTRACT

A bunting bag, particularly well-suited for use with children and child carriers, has a top panel detachably coupled to a bottom panel so that the top panel may be completely removed from the bottom panel. The bottom panel is configured or shaped to nest or mate in the child carrier without folds or substantial overhangs. The bottom panel includes a harness insert interface. A harness insert interface is provided that secures with the bottom panel via the harness insert interface.

5 Claims, 5 Drawing Sheets

BUNTING BAG

FIELD OF THE INVENTION

The present invention relates to a bunting bag, which is particularly suited for use with a child and, a child carrier or the like. More particularly, the present invention relates to a bunting bag having a generally shaped bottom portion configured for nesting or mating with a carrier or seat, a top portion that may be detachably coupled to the bottom portion for forming a bag and selectively covering portions of a person.

BACKGROUND OF INVENTION

The present invention relates generally to bunting bag coverings for child seats and more specifically to such coverings that are useable with stroller seats, infant carriers, and car seats to cover or partially cover a child seated in a stroller seat, infant carrier, or car seat.

Infant and child carriers, such as children's car seats, are designed to safely secure a child to protect the child during transportation and/or other activities. Child carriers include infant carriers, car seats, strollers, and the like. Child seats are typically designed to provide comfort to a child secured within the seat while securing the child safely within the seat. Typically these seats are made of a plastic or metal base and include fabric liners, padding, constraint belts, buckles, handles, wheels, and the like. Child seats may also include other components, such as pockets, shade coverings, wheel locks, and the like. Additional components and/or attachments are often used with child seats, such as toys that hang from a handle or trays that attach to the child seat that support the child's food or drink.

Children ranging from infants to grade school children may use child seats. In some situations, for example with infants and toddlers, it is desirable to provide a cover for warmth. This is because placing a coat or jacket on the child may make buckling the child in the seat more difficult. In addition, because the restraints cannot be secured on the child's body, there is slack that results in a less secure child. Placing blankets on top of the child may also be undesirable because they can fall off.

Bunting bags, such as disclosed in U.S. Pat. No. 6,012,189, have been developed to address some of these issues. A bunting bag is a perfect thing to have during long, cold winters. Such a bag resembles a miniature sleeping bag and envelops the baby entirely only leaving the face to peek out. The bag can be easily used in a car seat or stroller. They can also encase them without interfering with the restraints because they include slots through which the car seat straps may be passed to enable the child to be secured within the bag.

A shortcoming of existing bunting bags come from the fact that they are not easily removed from a car seat. This is because the straps for the car seat must be pulled back through the slots. As such, a bunting bag is not easily moved from a one car seat to another or from a car seat to a stroller.

SUMMARY OF THE INVENTION

The present invention is directed to a bunting bag that is used with a seat having restraining straps, such as a child's car seat or a stroller. The bunting bag comprises a flexible bottom panel sized and configured for a contoured fit with the seat. This flexible bottom panel is preferably formed of a soft, flexible material. A first or top surface of the bottom panel may include a stain resistant finish. A second or bottom surface of the bottom panel may be formed of a wear resistant material. The bottom panel further defines an opening that extends from the first surface to the second surface, and also defines a harness insert interface. The harness interface preferably is formed about the periphery of the bottom panel opening. The harness interface includes at least one means for connecting with a harness insert, which is discussed below. The means for connecting the harness insert interface to the harness insert can include any known method of detachably connecting two pieces of flexible material together, including but not limited to buttons, ties, belt and buckles, hook and loop connectors or materials, zippers, magnets, or the like. In one preferred embodiment, the harness insert interface includes a plurality of tab members about the periphery of the bottom panel opening which include one half of hook and loop connectors.

The harness insert includes a complementary part of the means for connecting the harness insert interface to the harness insert. For example, if the harness insert interface includes a surface with hook connectors, the corresponding region of the harness insert should include loop connectors. The harness insert is preferably configured to fit within and span the bottom panel opening. The harness insert has a first or top surface, and a second or bottom surface. At least one through aperture is defined by the harness insert that extends from the top surface to the bottom surface. The at least one aperture is configured or adapted to allow the restraining straps of the seat to be passed therethrough.

A flexible top panel is provided, which is detachably coupled to and selectively covers at least a portion of the bottom panel. The cooperation of the top panel and the bottom panel form what is essentially a bag. The top panel is preferably secured along at least a portion of its periphery to a corresponding portion of the bottom panel periphery. The top panel may be secured with the bottom panel by any securement means known in the art for detachably securing material together. In a preferred embodiment, the top panel and bottom panel are secured with one another by way of a zipper. The bottom surface of the top panel, which will contact the child, is preferably a softer material that may include stain resistant treatments. The top surface of the top panel, which faces outwardly is preferably formed of an aesthetically pleasing material.

In some embodiments, the bunting bag may include a detachable hood member. This hood member may be attached to the bottom panel by way of ties, zipper, hook and loop connectors, buttons, or the like. In yet other embodiments, the bunting bag may include strap members to further secure the bunting bag to the seat. A first strap member may be provided that extends across a rear portion of the bottom panel and engages the seat. A second strap member may extended partially across the rear portion of the bottom panel in substantially perpendicular alignment with the first strap, and connect to the second strap member.

In other preferred embodiments, the top panel may be openable. For example, the top panel may include a first side panel and a second side panel. The first side panel may extend partially across the bottom panel, such as half way across. The second side panel may also extend partially across the bottom panel, or the remaining half. The first side panel and second side panel collectively span the bottom panel. The first and the second side panel may be detachably secured to one another by way of buttons, zippers, hook and loop connectors, snaps, or the like.

BRIEF DESCRIPTION OF THE DRAWINGS

Illustrative, non-limiting embodiments are shown in the drawings, in which.

DETAILED DESCRIPTION OF EMBODIMENTS

Preferred embodiments of the claimed bunting bag are hereunder described with reference to the attached drawings.

Figure 1:
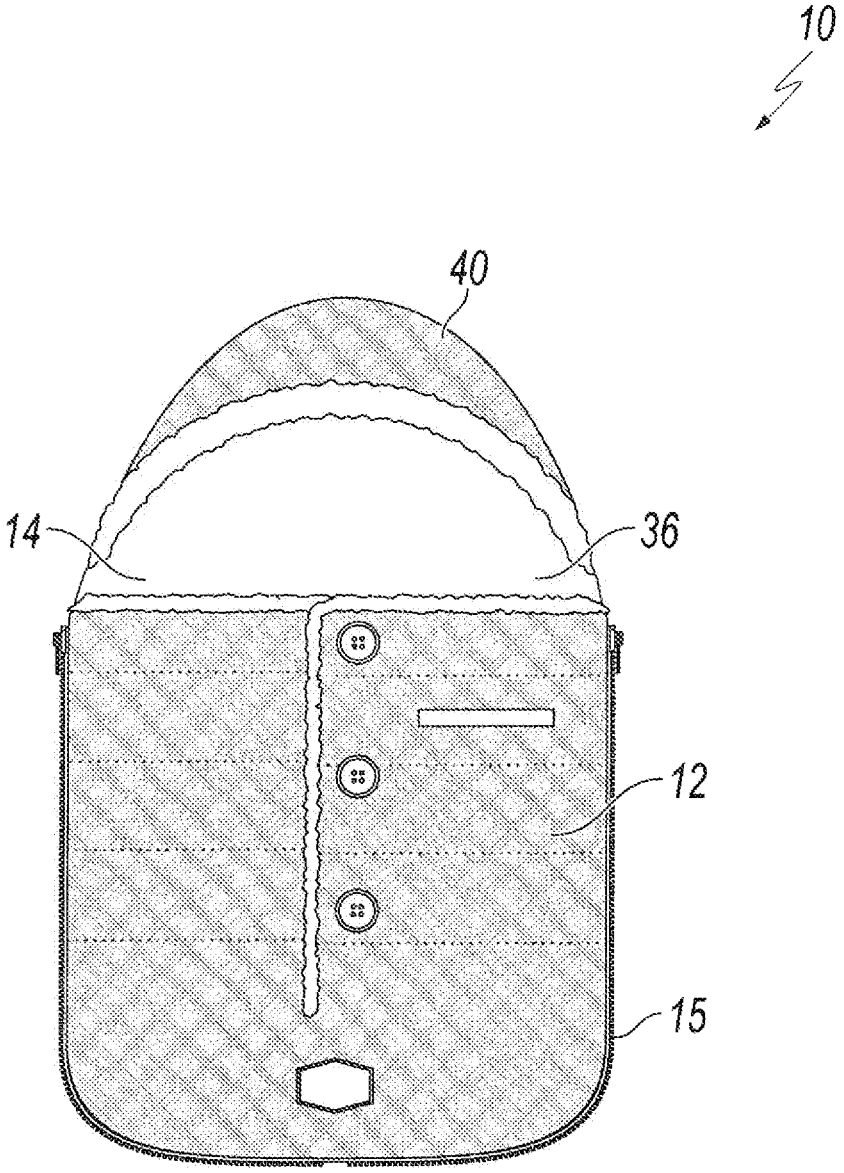
FIG. 1 illustrates a front elevated view of a preferred embodiment of the present invention.
Figure 2:
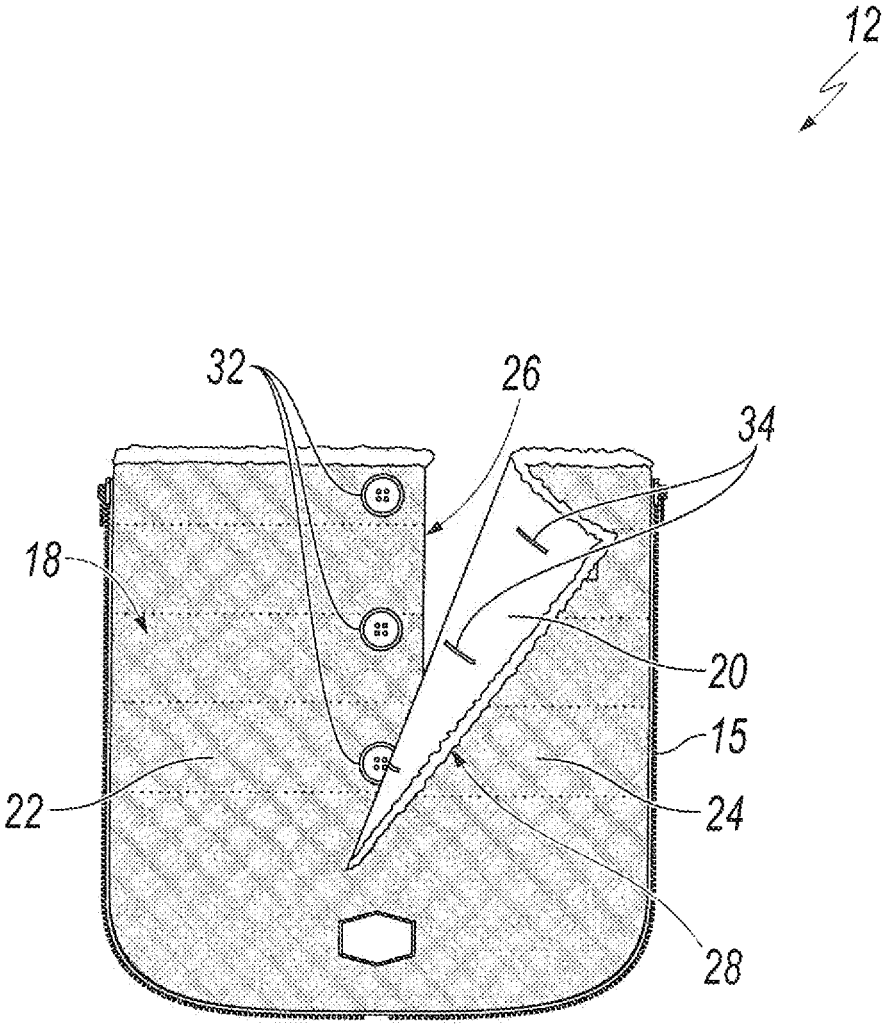
FIG. 2 illustrates the front elevated view of the top panel of FIG. 1 in a partially opened condition.
Figure 3:
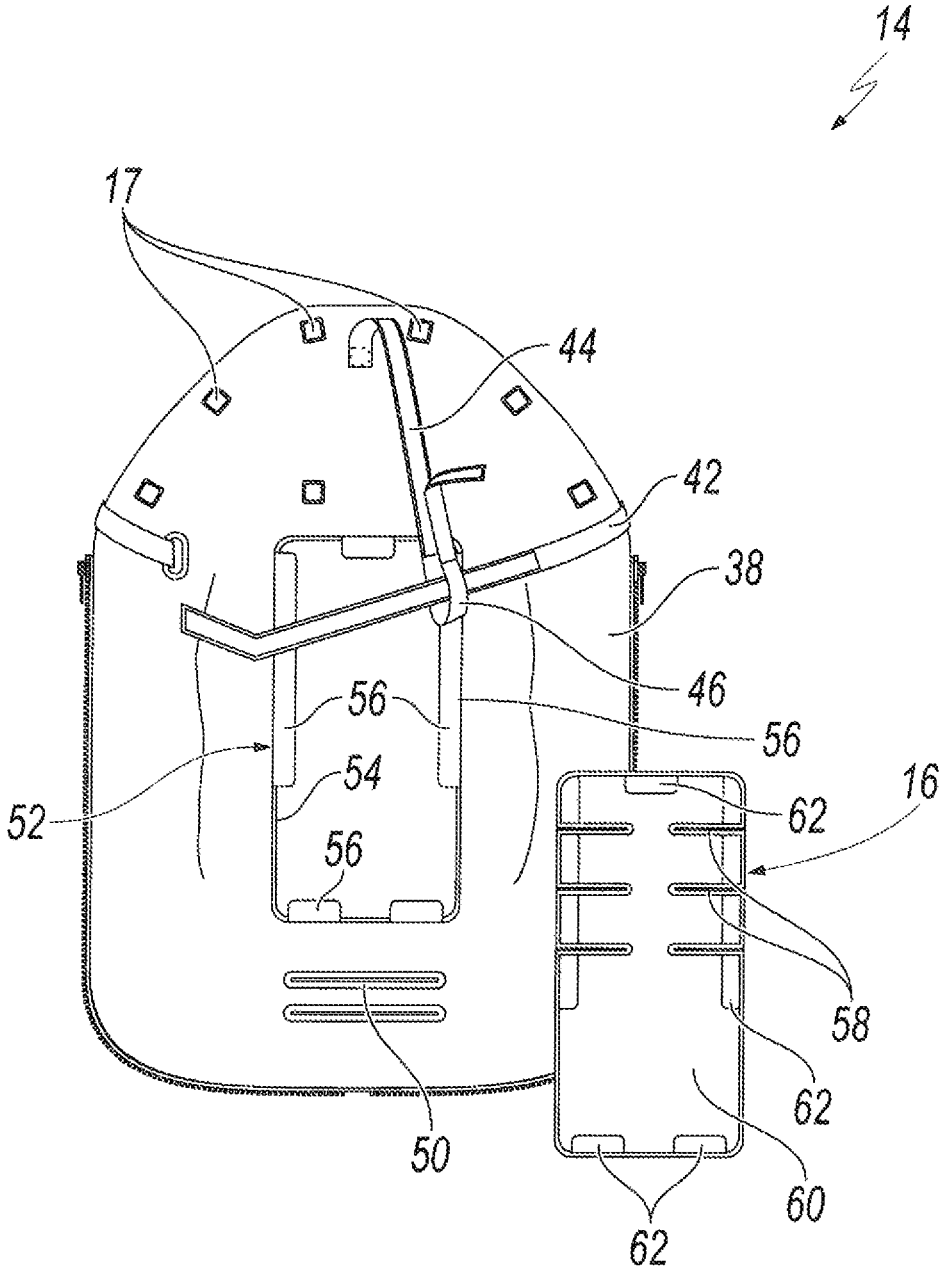
FIG. 3 illustrates a rear elevated view of the embodiment of FIG. 1.

Referring to FIGS. 1, 2, and 3, the from and back of a preferred embodiment of a bunting bag according to the present invention is discussed. Bunting bag 10 includes a top panel 12, a bottom panel 14, and a harness insert 16. In FIG. 3, the harness insert 16 is shown as detached from bottom panel 14. In use, the harness insert 16 would be secured to bottom panel 14, as discussed below.

Referring to FIGS. 1 and 2, the top panel 12 includes a first surface 18 and a second surface 20. The top panel 12 includes a first side panel 22 and a second side panel 24. The first side panel 22 extends partially across the width of the bottom panel. The second side panel 24 starts at the opposed side of the top panel 12 and extends towards first side panel 22. The combination of first side panel 22 and second side panel 24 extends fully across the width of top panel 12, and in this embodiment, may overlap one another. The terminal edge portions 26 and 28 of first side panel 22 and second side panel 24, respectively, are detachably secured with one another. In this embodiment, first side panel 22 includes a plurality of buttons 32, and second side panel 24 includes a corresponding plurality of button holes 34. As should be apparent, first side panel 22 is connected with second side panel 24 by buttoning them together. When desired, the first side panel 22 can be detached from second side panel 24 by unfastening the connection means, which in this embodiment are buttons. Any other means for detachably securing fabric pieces may be used, including but not limited to zippers, hook and loop enclosures, ties, snaps, belts and buckles, magnets or the like.

The outer surface of top panel 12 may be treated with a water repellant finish, or the top panel may include a water repellant material. Preferably, the bunting bag 10 is made with a breathable material. As shown, top panel 12 may also include various decorative features.

Top panel 12 is detachably secured with bottom panel 14. In this embodiment, top panel 12 is detachably secured with bottom panel 14 about their respective peripheral portions by a zipper 15. By unzipping zipper 15, the top panel 12 may be partially or completely removed from the bunting bag when desired. As with the side panels, the top panel may be detachably secured with the bottom panel by a variety of means, such as buttons, hook and loop enclosures, ties, snaps, belts and buckles, magnets or the like.

Figure 4:
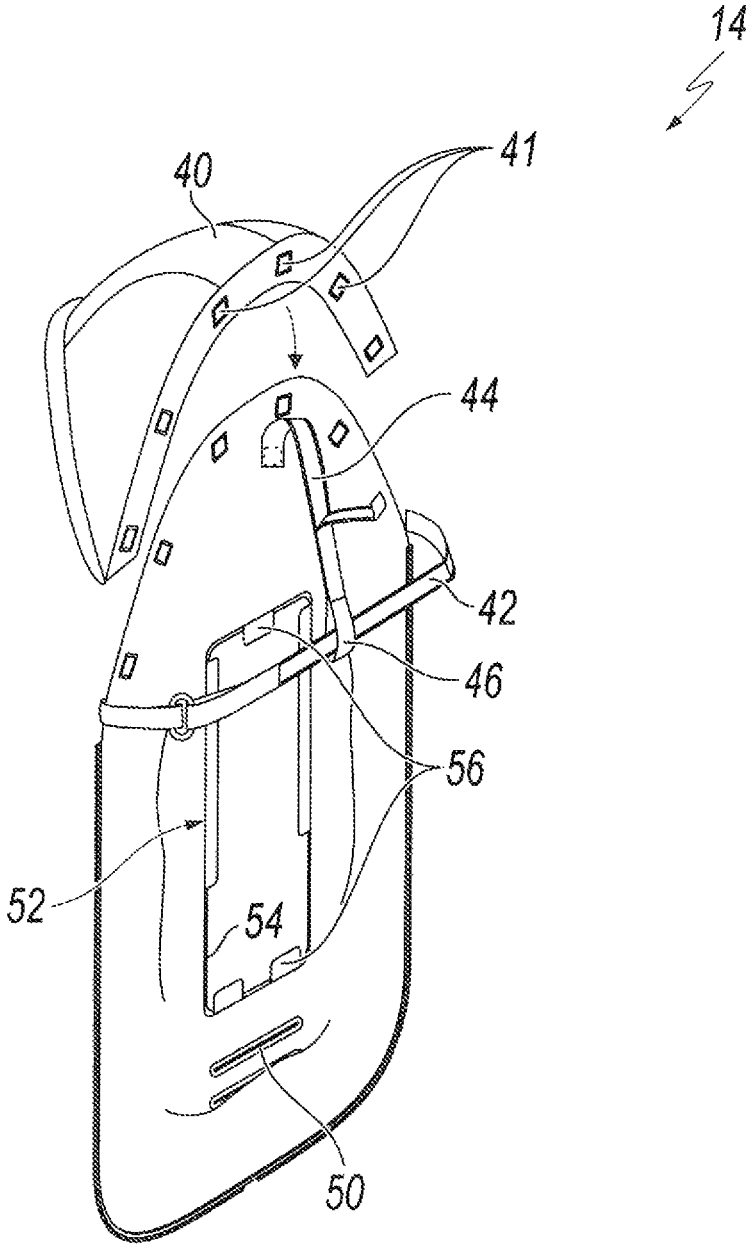
FIG. 4 illustrates a rear perspective view of the bottom panel and hood of FIG. 1.

Referring to FIG. 3, the bottom panel 14 and harness insert 16 are shown. Bottom panel 14 includes a first surface 36 (FIG. 2) and a second surface 38. Formed along an upper peripheral portion of bottom panel 14 are a plurality of securement regions 17 that include loop connectors. Referring to FIG. 4, removable hood 40 includes a corresponding plurality of securement regions 41 that include hook connectors. It should be recognized that other means for connecting the hood to the bottom panel may be uses, such as a zipper, buttons, magnets, ties, or the like.

Also formed with the bottom panel 14 is a first strap member 42. First strap member 42 extends across a rear portion or second surface 38 of the bottom panel 14. First strap member is formed with extendable regions, such as with an elastic material. A second strap member 44 is secured with an upper region of bottom panel 14 and extends partially across the rear portion 38 of the bottom panel 14 in substantially perpendicular alignment with the first strap member 42. The second strap member is securable with the first strap member. As shown, the second strap member 44 includes a distal end portion that defines a loop 46 through which the first strap member 42 is passed. Alternatively or additionally, the distal end portion may include a hook and loop enclosure to form loop 46. First strap member 42 may be stretched around the car seat to secure the bottom panel 14 thereto. Preferably formed in a lower portion of bottom panel 14 are one or more apertures 50 that are configured to allow a restraining strap to be passed through.

Bottom panel 14 further defines a harness insert interface 52 that includes opening 54 and securement members such as tab members 56. In a preferred embodiment, opening 54 is of substantially the same size and shape as harness insert 16. Harness insert 16 includes a plurality of apertures 58, which are configured to allow restraining straps of the car seat to be passed through. Several apertures are provided to allow the height of the straps relative to the child to be adjusted. Formed on a second surface 60 of harness 16 are a plurality of securement regions 62. These correspond with the tab members 56 of the harness insert interface 52. When the harness insert 16 is positioned within or over opening 54, tab members 56 are secured with securement regions 62 to attach the harness insert 16 to the bottom panel 14. As such, the bottom panel 14 and top panel 12 can be removed from the car seat without having to remove the car seat straps. Instead, one can simply detach the harness insert 16 from the bottom panel 14. By having multiple harness inserts, the same bottom panel 14 and top panel 12 can be easily interchanged with bunting bags in different car seats or strollers by securing them to harness inserts for those other seats. In this embodiment, apertures 50 are show n as being formed in the bottom panel. Although, not depicted, it should be understood that it may be preferred that the bottom panel 14 includes no apertures for straps, and that the harness insert 14 would include all strap apertures. It should further be understood that while a single harness insert is depicted, multiple harness inserts and multiple harness insert interfaces may be utilized.

Figure 5:
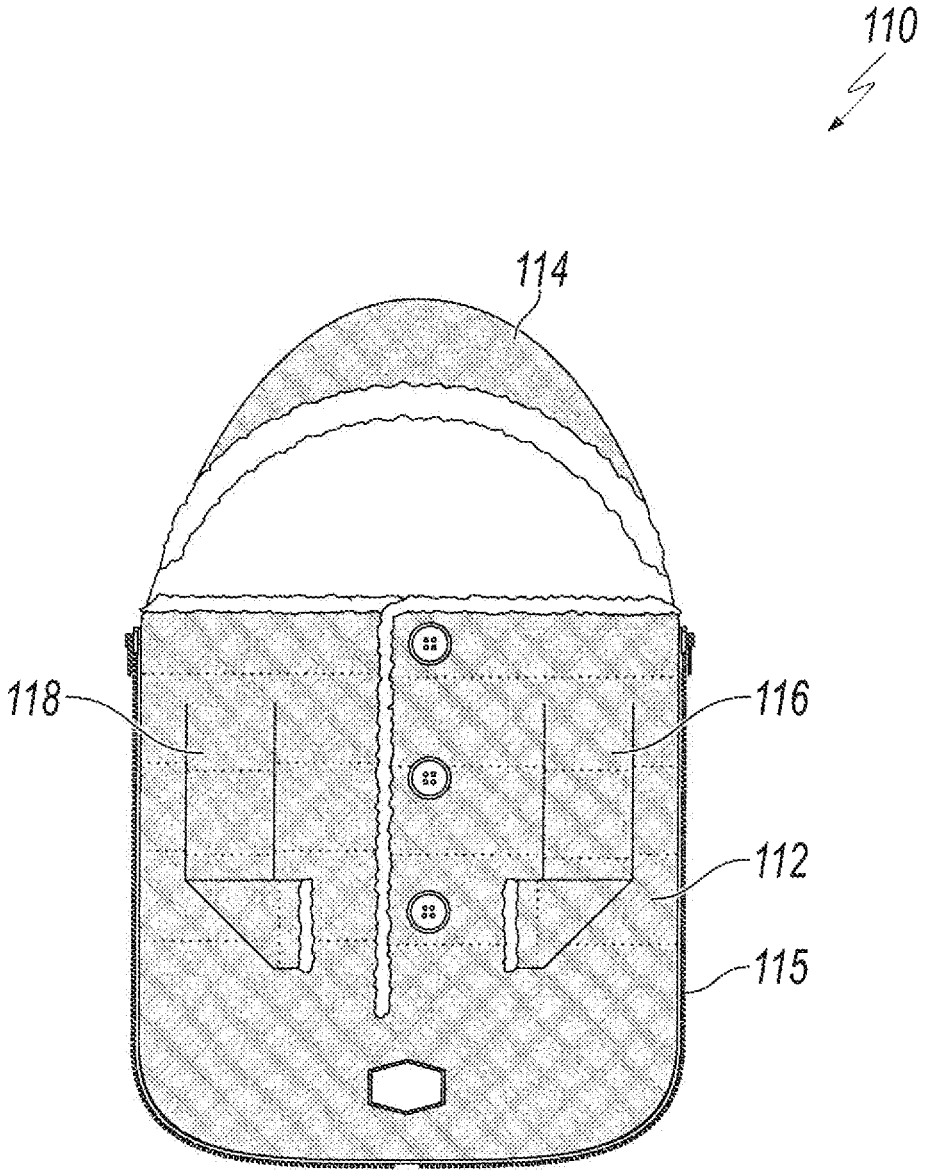
FIG. 5 illustrates a front elevated view of an alternative embodiment of the present invention.

Referring to FIG. 5, an alternative embodiment of the present invention is described. Bunting bag 110 is similar in many respects to the previous embodiment. As before, bunting bag 110 includes a flexible bottom panel 114 sized and configured for a contoured fit with the seat. Although not shown here, the bottom panel 114 also defines an opening and a harness insert interface, wherein the harness insert is detachably coupled to the bottom panel via the harness insert interface, and wherein the harness insert includes a plurality of openings to receive restraining straps of the seat. Top panel 112 is detachably secured with bottom panel 114 by zipper 115. The flexible top panel 112, in this preferred embodiment, has sleeves 116 and 118 attached thereto. The sleeves 116 and 118 may be integrally formed with top panel 112 as shown, or may be detachably secured to the top panel 112 by way of hook and loop fasteners, zippers, or the like. In this particular embodiment, the sleeves are attached only to the top panel. However, in some embodiments, the sleeves may be attached to both the top panel and bottom panel, or possibly, just the bottom panel.

Although the bunting bag of the present invention has been described and illustrated with reference to a preferred embodiment which is particularly well suited for use with children and child seats, it is of course understood that the bunting bag of the present invention may be easily configured for various other persons and seats. For example, the bunting bag may be sized for use with larger children or adults. The bottom and top portions may be shaped or configured for use with particular types of seats, including wheel chairs or arm chairs. In addition, it is understood that the bunting bag need not be used with a child carrier or other seat, but may be used separate from the carrier or seat, such as to hold the child.

Although only a few embodiments of the present inventions have been described in detail in this disclosure, those skilled in the art who review this disclosure will readily appreciate that many modifications are possible without materially departing from the novel teachings and advantages of the subject matter recited herein.

I claim:

1. A bunting bag for use with a seat having restraining straps, the bunting bag comprising: a flexible bottom panel sized and configured for a contoured fit with the seat; a flexible top panel, detachably coupled to and selectively covering at least a portion of the bottom panel; at least one of the top panel or bottom panel including at least one panel fastener disposed about a periphery thereof for variably attaching the top panel to the bottom panel; the bottom panel further defining an opening and a harness insert interface formed around a periphery of the opening; and a harness insert, the harness insert including a plurality of apertures configured to permit strap member to pass therethrough, the harness insert further being detachably coupled to and removable from the bottom panel via the harness insert interface, further comprising a first strap member extending across a rear portion of the bottom panel and a second strap member extending partially across the rear portion of the bottom panel in substantially perpendicular alignment with the first strap, the second strap member securable with the first strap member.

2. A bunting bag for use with a seat having restraining straps, the bunting bag comprising: a flexible bottom panel sized and configured for a controlled fit with the seat, the bottom panel further defining an opening and a harness insert interface formed around a periphery of the opening; a flexible top panel detachably coupled to and selectively covering at least a portion of the bottom panel; and a harness insert, the harness insert including a plurality of apertures configured to permit strap member to pass therethrough, the harness insert further being detachably coupled to and separable from the bottom panel via the harness insert interface, further comprising a first strap member extending across a rear portion of the bottom panel and a second strap member extending partially across the rear portion of the bottom panel in substantially perpendicular alignment with the first strap, the second strap member securable with the first strap member.

3. The bunting bag of claim 2, further comprising a detachable hood member.

4. The bunting bag of claim 2, further comprising a first strap member extending across a rear portion of the bottom panel and a second strap member extending partially across the rear portion of the bottom panel in substantially perpendicular alignment with the first strap, the second strap member securable with the first strap member.

5. The bunting bag of claim 2, wherein the top panel includes a first side panel and a second side panel, the first side panel extending partially across the bottom panel, the second side panel extending partially across the bottom panel, wherein the first side panel and second side panel extend fully across the bottom panel, at least one of the first and the second side panel including a side panel fastener for variably attaching the first side panel to the second side panel.

* * * * *